US012389962B2

(12) United States Patent
Salvarani

(10) Patent No.: US 12,389,962 B2
(45) Date of Patent: Aug. 19, 2025

(54) QUICK OPENING/CLOSING SYSTEM FOR A GLOVE FOR SLIDING OUT THE FIRST FINGERS

(71) Applicant: Marco Salvarani, Goito (IT)

(72) Inventor: Marco Salvarani, Goito (IT)

( * ) Notice: Subject to any disclaimer, the term of this patent is extended or adjusted under 35 U.S.C. 154(b) by 0 days.

(21) Appl. No.: 18/567,955

(22) PCT Filed: Jun. 1, 2022

(86) PCT No.: PCT/IB2022/055130

§ 371 (c)(1),
(2) Date: Dec. 7, 2023

(87) PCT Pub. No.: WO2022/259093

PCT Pub. Date: Dec. 15, 2022

(65) Prior Publication Data

US 2024/0268495 A1 Aug. 15, 2024

(30) Foreign Application Priority Data

Jun. 9, 2021 (IT) ..... 102021000014729

(51) Int. Cl.
*A41D 19/00* (2006.01)

(52) U.S. Cl.
CPC ..... *A41D 19/0017* (2013.01)

(58) Field of Classification Search
CPC ..... A41D 19/0013; A41D 19/0017; A41D 19/00; A41D 19/0082; A41D 19/0044; A41D 19/001; A41D 19/02; A41D 19/0055; A41D 19/0068; A41D 19/0072; A41D 19/015; A63B 71/141; A63B 71/146
USPC ..... 2/163, 159
See application file for complete search history.

(56) References Cited

U.S. PATENT DOCUMENTS 2,318,785 A * 5/1943 Kopplin ..... A41D 19/01 2/158
2,583,902 A * 1/1952 Tatar ..... A41D 19/02 2/159
2,653,601 A * 9/1953 Morrison ..... A41D 19/0006 602/64
2,830,299 A * 4/1958 Thilenius ..... A41D 19/01 2/158
RE31,538 E * 3/1984 Antonious ..... A63B 71/146 2/160

(Continued)

FOREIGN PATENT DOCUMENTS

DE 202018100272 U1 * 3/2018
FR 44091 E * 10/1934

(Continued)

OTHER PUBLICATIONS

English translation (Google translate) of FR 44091 (Cadilhac). Doc Pub Oct. 1934 (Year: 1934).*

*Primary Examiner* — Amy Vanatta
(74) *Attorney, Agent, or Firm* — Dickinson Wright PLLC; Andrew D. Dorisio

(57) ABSTRACT

A quick opening/closing system (10) of a glove (A) for sliding out the first three fingers of a hand, comprising a cutting line (2) on the back of the glove from the junction of the third and fourth fingers of the hand (middle finger and ring finger) and extending to below the base of the thumb and above the wrist to define an openable portion (B) of said glove (A) integral with the glove itself.

10 Claims, 7 Drawing Sheets

(56) References Cited

U.S. PATENT DOCUMENTS

| | | | | | |
|---|---|---|---|---|---|
| 4,654,895 | A | | 4/1987 | Peters | |
| 4,704,743 | A | * | 11/1987 | Thornell | A41D 19/0013 2/163 |
| 5,020,160 | A | * | 6/1991 | Cano | A41D 19/0093 2/161.7 |
| 5,328,449 | A | * | 7/1994 | Andrews | A61L 15/26 2/161.7 |
| 5,444,874 | A | * | 8/1995 | Samelian | A41D 19/0013 2/917 |
| 5,680,654 | A | | 10/1997 | McClanahan | |
| 7,451,496 | B2 | * | 11/2008 | Carey | A41D 19/01594 2/160 |
| D655,050 | S | * | 2/2012 | Fraga | D29/117.1 |
| 8,646,115 | B1 | | 2/2014 | Baunach | |
| 2005/0102732 | A1 | | 5/2005 | Nakagawa | |
| 2010/0058513 | A1 | * | 3/2010 | Drosihn | A41D 19/0058 2/162 |
| 2016/0255892 | A1 | * | 9/2016 | Berry | A41F 1/06 |
| 2020/0281291 | A1 | * | 9/2020 | Balcarczyk | A41D 19/00 |
| 2021/0235796 | A1 | * | 8/2021 | Razdan | A41D 19/0006 |

FOREIGN PATENT DOCUMENTS

| | | | |
|---|---|---|---|
| FR | 1482070 | A | 5/1967 |
| GB | 2284341 | A | 6/1995 |

* cited by examiner

QUICK OPENING/CLOSING SYSTEM FOR A GLOVE FOR SLIDING OUT THE FIRST FINGERS

TECHNICAL FIELD

The present invention relates to a quick opening/closing system of a glove for sliding out the first three fingers.

BACKGROUND

More in particular, the present invention relates to an opening/closing system for a glove to be worn on the hands of an individual suitable to allow a partial opening of the glove to free the fingers of the hands and improved with respect to the known gloves of traditional use.

As is known, the traditional type of gloves are commonly defined as the "mitten" type and are of two main types. The first type is defined by a glove which comprises two compartments, one of which can be opened to uncover the index, middle, ring and little finger, and one that can be opened only for the thumb.

Such a first type, however, has a technical disadvantage linked to the fact that when the glove is worn in a closed glove configuration, the movement allowed is the simultaneous bending of the four fingers of the hand without the possibility of selectively using some fingers with the exclusion of the others (for example, in the case of an index-middle finger gripping movement) and when the glove is in an open configuration there is an inconvenience of reducing the functional capacity of the hand since the four fingers remain inside a single exit hole which covers them up to the base of the second phalanx; the thumb instead always remains covered by the glove both in the closed glove configuration and the in open glove configuration and such a configuration limits the precision in the use of the fingers and the functionality of the hand in the gripping grip movements between the thumb and the other fingers.

A further disadvantage of such a type of glove is that the hood which covers the four fingers of the hand, when it is open, is overturned on the back of the glove, increasing the encumbrance and making it almost impossible to put the hand in a pocket without having to remove the glove itself. The second type is defined by a glove of the "mitten" type in which the five fingers of the hand are individually covered for about half their length and which comprises a folding hood which, if necessary, covers the index, middle, ring and little finger.

However, this glove model also has significant drawbacks related to a limitation of the functionality of the hand as the four fingers are covered by the hood and, therefore, the only possible movement is their simultaneous bending. A further drawback is that when the fingers are covered by the hood, it is impossible to perform selective finger movements, such as typing on a keyboard, pressing a trigger, or counting banknotes, or performing other actions which require the use of individual fingers of the hand. Furthermore, with the glove in open configuration the hood is folded over the back of the glove, increasing the size of the same as already described previously with the first type of glove.

Even if traditional five-finger gloves are worn, it is impossible to take full advantage of the sensitivity of the fingers and perform fine movements such as putting a hand in a pocket to remove coins or handle a small object or the like and to perform these actions it is always necessary to remove the glove.

The above has drawbacks related to the loss of time of such an operation, to the need to find a support or shelter for the glove so that it does not fall or is not forgotten; for example, a motorcyclist at a refuelling stop should remove the glove or gloves to put his hand in his pocket, remove his wallet and take out banknotes or a card, place the glove in a safe place away from falls, carry out the refuelling operation, put the glove or gloves back on and set off.

SUMMARY

The object of the present invention is to overcome the drawbacks described above.

More specifically, an object of the present invention is to provide a partially opening glove which ensures a full functionality of the hand when worn in a closed system and which allows, in an open system, to exploit the maximum tactile sensitivity of the fingers in gripping and in precision movements.

These and other objects are achieved by the invention having the features according to claim 1.

According to the invention, a quick opening/closing system of a glove is provided for sliding out the first three fingers of a hand, comprising a cutting line on the back of the glove from the junction of the third and fourth fingers of the hand (middle finger and ring finger) and extending to below the base of the thumb and above the wrist to define an openable portion of said glove integral with the glove itself.

Advantageous embodiments of the invention appear from the dependent claims.

BRIEF DESCRIPTION OF THE DRAWINGS

The functional features of the quick opening/closing system of a glove for sliding out the first three fingers of the can be better clarified from the present invention following detailed description, in which reference is made to the attached drawings which illustrate a preferred and non-limiting embodiment, in which.

DETAILED DESCRIPTION

Figure 1:
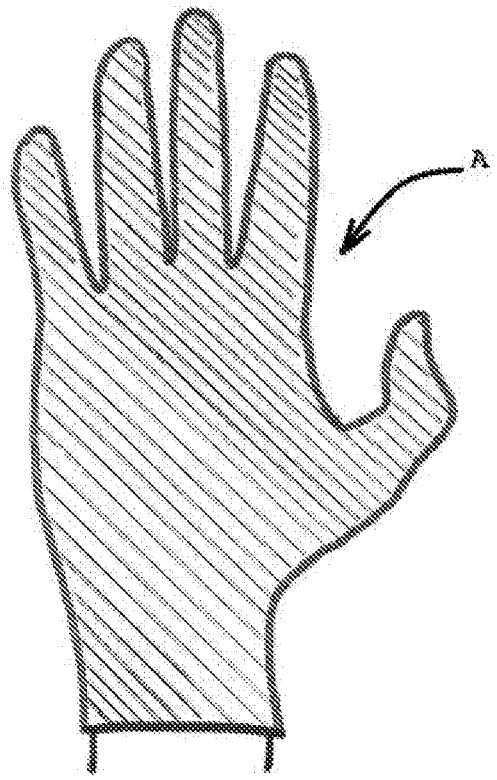
FIG. 1 schematically illustrates a glove (worn on the right hand) seen from the palm and provided with a quick opening/closing system of a glove to slide out the first three fingers of the present invention (not visible on the palm)

With reference to the aforementioned figures, the quick opening/closing system of a glove for sliding out the first three fingers of the present invention, indicated as a whole with 10, is applied to a glove A and comprises an opening portion B defined by a cutting line 2 on the back of the glove (FIG. 2) starting from the junction of the third and fourth fingers of the hand (middle finger and ring finger) and arriving to below the base of the thumb just above the wrist.

The edge of the cutting line 2 comprises a small tab 4 externally protruding with respect to the opening portion B to allow an easy grip with the opposite hand in order to open and close the glove (FIGS. 2, 3, 6, 7 and 9).

On the back of the hand the closure of the system is ensured by a hook and loop fastener, or Velcro® surface (FIGS. 3, 4 and 6) comprising two coupling parts and defined by a first surface or strip 7 on the portion of the back of the glove and a second surface or strip 9 placed on an inner front of the tab 4 facing the back of the glove.

The hook and loop fastener, or Velcro® closure on the back of the glove allows to quickly uncover the first three fingers of the hand (FIGS. 5, 7, 12, 12A, 13 and 13A) and ensures the closure of the glove.

When the system is open (FIGS. 3, 4, 5, 6, 7, 12, 12A, 13 and 13A) the first three fingers of the hands are free to perform fine movements and exploit the tactile sensitivity of the fingertips.

In FIGS. 3, 4, 5, 7, 12, 12A, 13 and 13A it can be seen that, with the system open, the palm of the hand remains uncovered and free from the glove and the fingers (thumb, index and middle) are free to move, with the remaining fingers (ring finger and little finger) which remain inside the glove and prevent the glove from slipping off.

The part of the glove which covers the fourth finger has a hem 3 (FIGS. 8, 10, 11) which goes up towards the tip of the third finger and reaches up to the middle of the first phalanx of the third finger, embraces the first phalanx for about half of its circumference, from the midline of the back of the finger to the midline on the opposite side, covering the middle of the third finger facing the fourth finger.

The external surface of the hem 3 is coated with soft rubber from the base of the third finger to the end of the hem 3 and from the base of the third finger to the middle of the first phalanx of the fourth finger.

Figure 10:
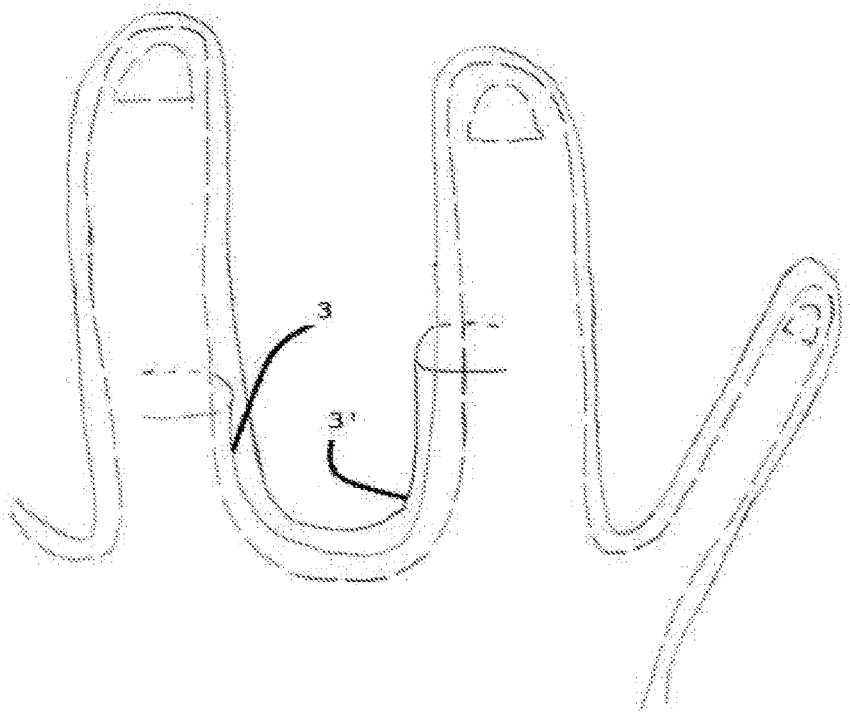
FIG. 10 schematically illustrates a partial and transparent view of the glove provided with the opening/closing system of the invention in a closing configuration with a depiction of the third and fourth fingers of the hand (right hand) with a view from the side of the back of the hand.

The third finger of the glove, in turn, has a similar hem 3' (FIG. 10), convex downward, which rises up to the middle of the first phalanx of the fourth finger and rests on the opposite edge when the glove is closed (FIG. 10). The inner face of the hem 3' of the third finger is coated with soft rubber and rests over the opposite hem when the glove is closed.

This system allows to reduce the risk of water infiltration inside the glove.

Figure 6:
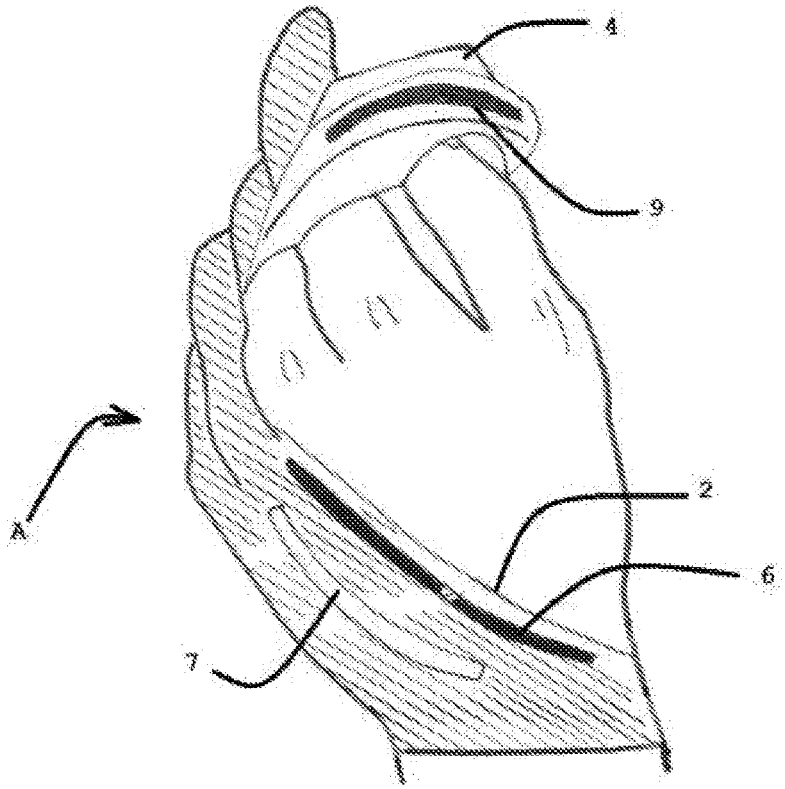
FIG. 6 illustrates a schematic view of a glove provided with the opening/closing system in the act of sliding off (back of the hand)
Figure 7:
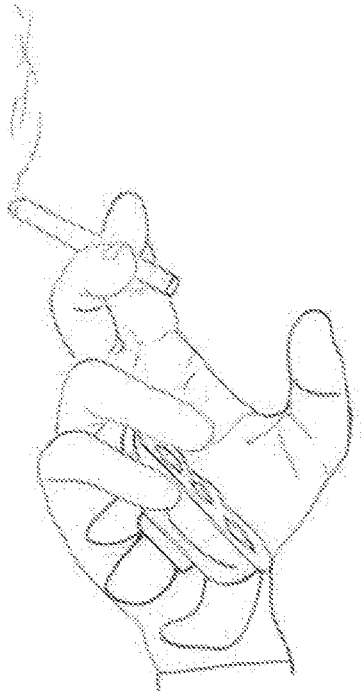
FIG. 7 schematically illustrates a glove provided with the opening/closing system of the invention in an open configuration and in a use condition (for example with the two index and middle fingers free, holding a cigarette)
Figure 8:
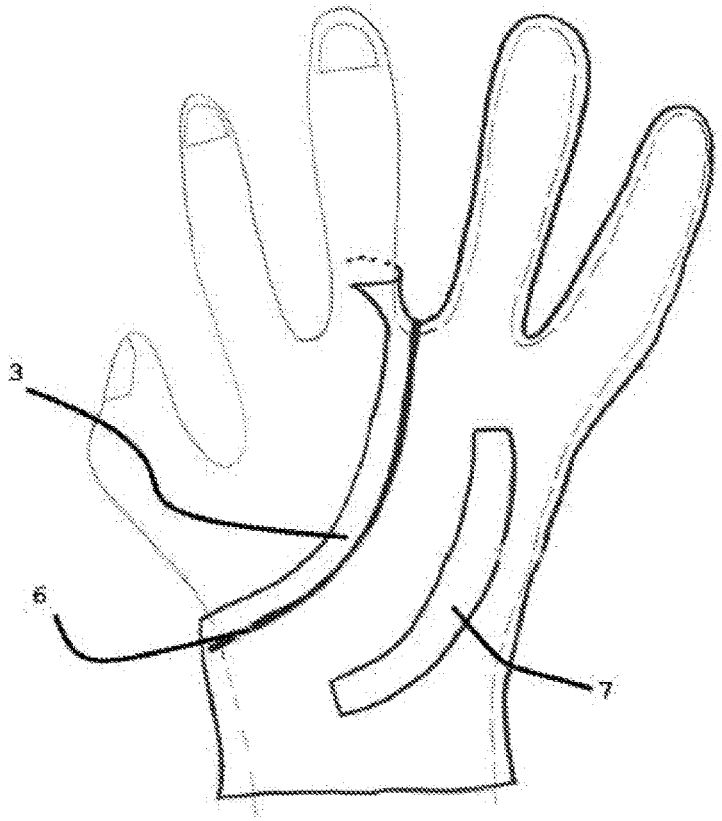
FIG. 8 schematically illustrates a glove provided with the system of invention the seen from the back and partially sectioned.

The risk of water infiltration is further reduced by the presence of a strip 6 of soft rubber approximately 1-2 mm thick, projecting on the back surface of the glove (FIGS. 4 and 9 in transparency) which runs from the base of the fourth finger to the base of the thumb (FIG. 6, FIG. 8).

Another strip of rubber of the same thickness (approximately 1-2 mm) runs on the inner face of the cutting line 2.

Figure 9:
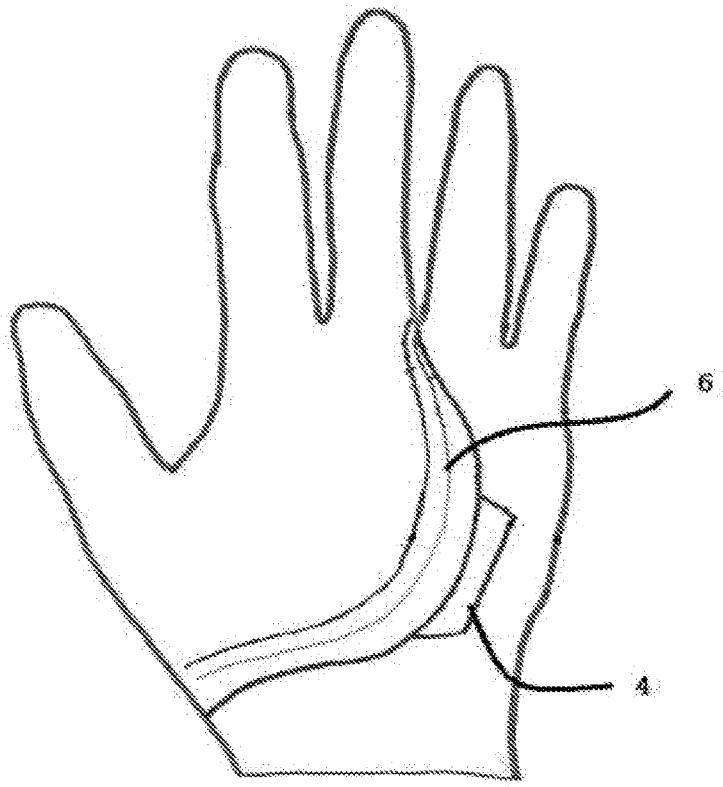
FIG. 9 schematically illustrates a glove (right hand and back side) provided with the opening/closing system of the invention in a closed configuration.

When the glove is closed, these two rubber strips are parallel to each other at a distance of approximately 2 mm and form a "track" which acts as a barrier to any water infiltration (FIG. 9 in transparency).

In FIGS. 12, 12A, 13 and 13A some examples of fine and coordinated use of the first three fingers of the hands which are possible with the glove opening/closing system of the invention.

Figure 2:
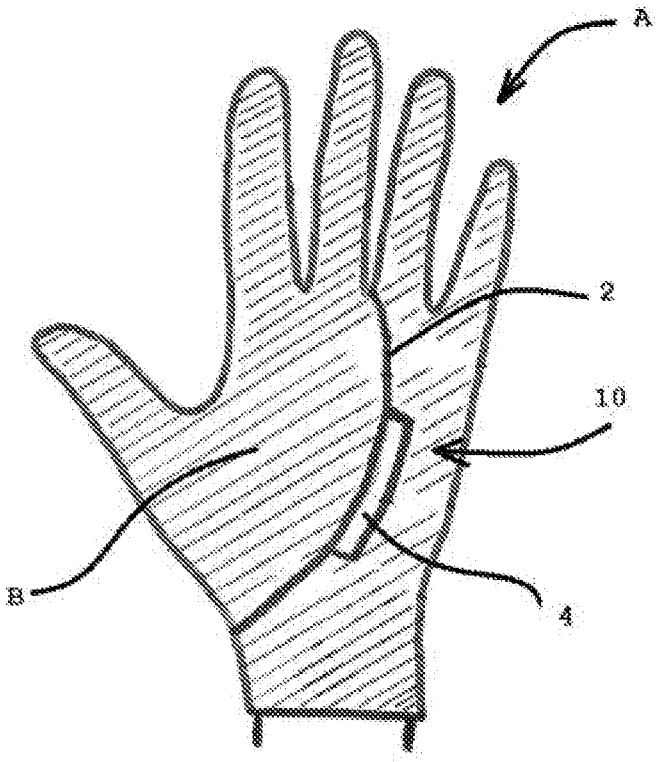
FIG. 2 schematically illustrates a view from the back of the hand of a glove provided with the opening/closing system of the invention.

With reference to the figures, FIG. 1 depicts the glove worn with the opening/closing system of the invention closed, with the glove applied to the right hand, with a view from the palm side, while FIG. 2 illustrates the same glove worn in a view from the back side of the hand.

Figure 3:
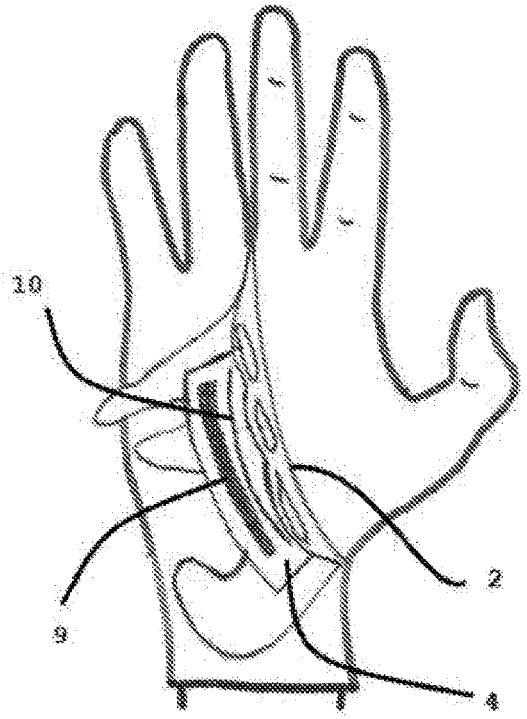
FIG. 3 schematically illustrates a glove provided with the opening/closing system of the invention in an open configuration (seen from the palm)
Figure 4:
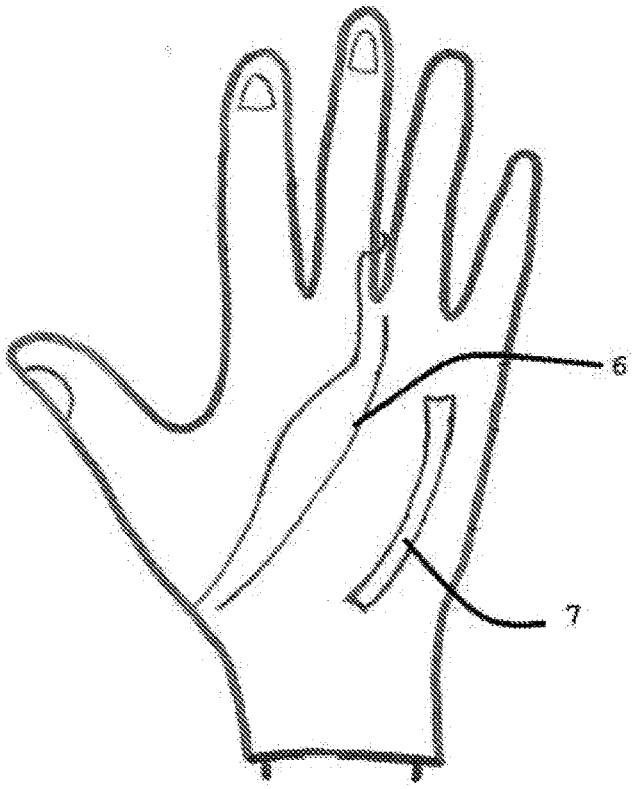
FIG. 4 schematically illustrates a glove provided with the opening/closing system of the invention in an open configuration (back side view)
Figure 5:
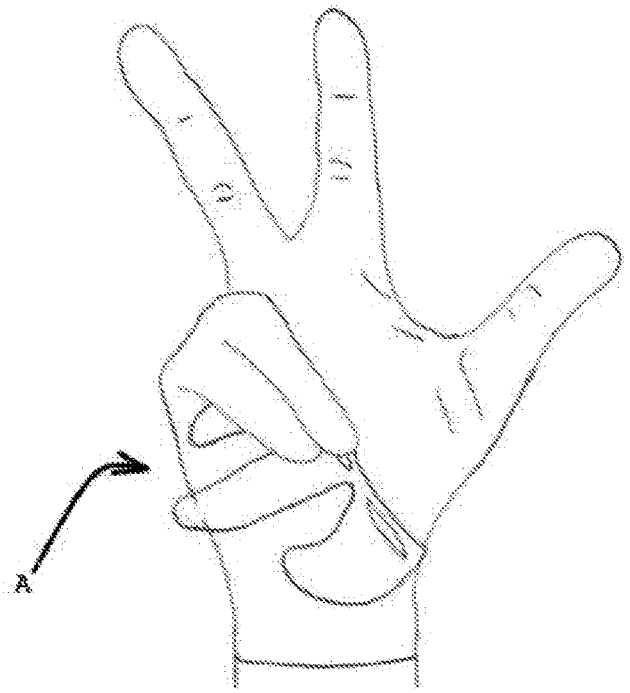
FIG. 5 schematically illustrates a further view of the glove provided with the opening/closing system of the invention in an open configuration (seen from the palm)

FIGS. 3 and 4 depict the glove worn with the opening/closing system in the opening configuration, with reference to a right hand and on the palm side (FIG. 3) and on the back side (FIG. 4).

The numerical reference 10 indicates the soft rubber strip on the surface of the glove which serves to limit water infiltrations.

FIG. 6 shows the glove worn with the opening/closing system partially open, with the glove applied to the left hand and a back view of the hand.

FIG. 8 depicts the right hand in back side view, in transparency with visibility of the edge of the hand inside the glove.

FIG. 8 depicts the profile of the glove worn, with the system in open mode, the cutting line 2 and the fingers of the glove defined by the thumb, index and middle fingers are assumed to be hidden by the hand for convenience of explanation.

FIG. 9 illustrates the glove applied to the right hand seen from the back, in transparency with the glove system closed.

In FIG. 10, transparency, a detail of the opening/closing system between the third and fourth fingers described above is depicted, with the system in a closing configuration with the glove applied to the right and in back side view.

With reference to such a figure, the number 3 indicates the surface of the glove covering the fourth and fifth fingers, the hem remaining below the opposite hem.

In a closed system the two parts of the glove overlap, closing in contact with each other and limiting the infiltration of water inside the glove.

Figure 11:
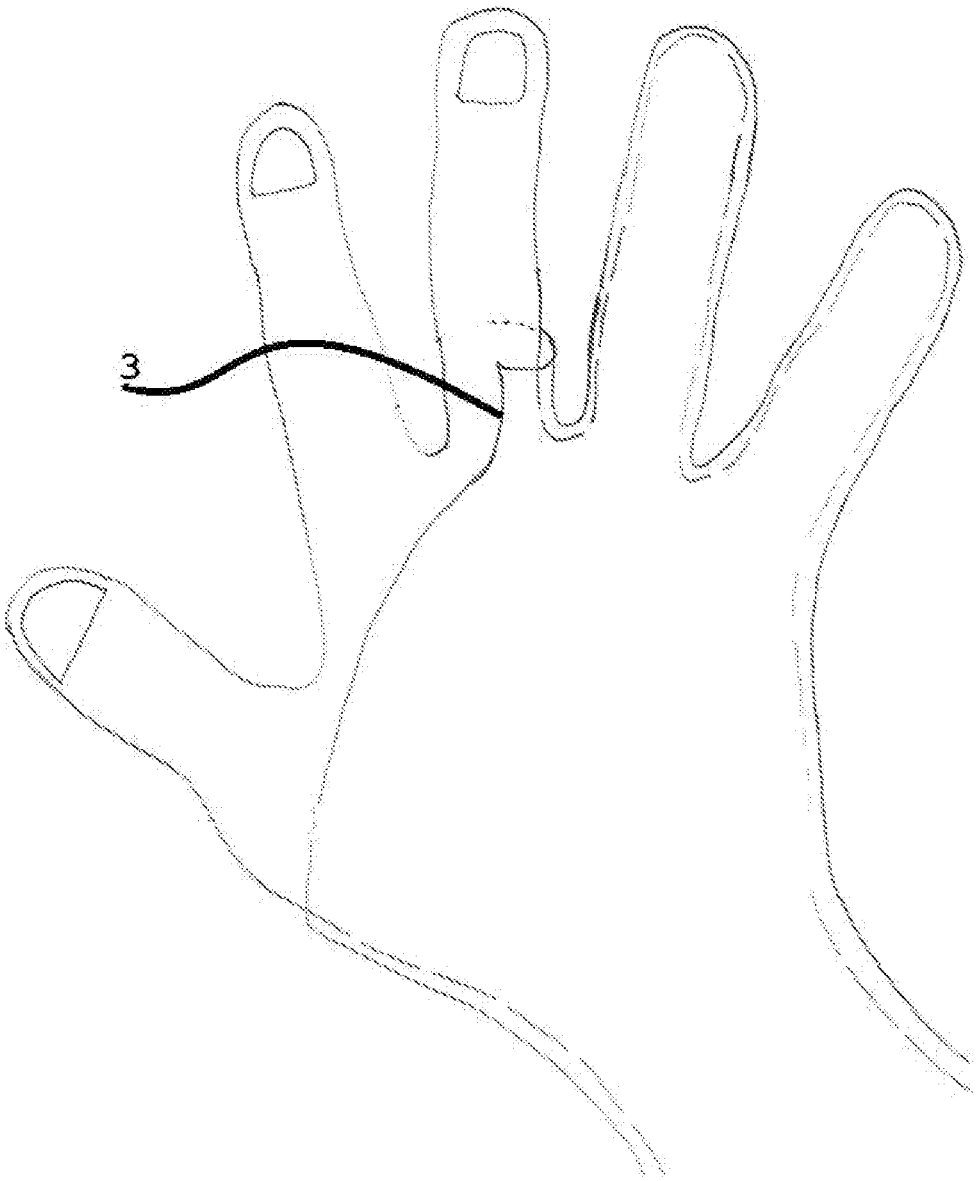
FIG. 11 schematically illustrates a further partial view of a glove provided with the opening/closing system of the invention, with said glove seen from the back side, fitted on the right hand and in an opening configuration.
Figure 12:
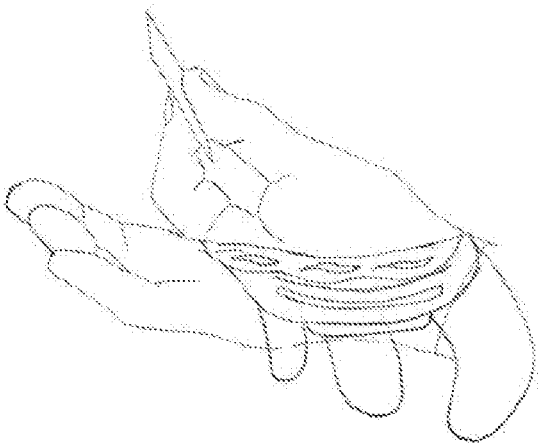
FIGS. 12/12A and 13/13A schematically illustrate two examples of use of the glove provided with the opening/closing system of the invention in the act of gripping objects.
Figure 12A:
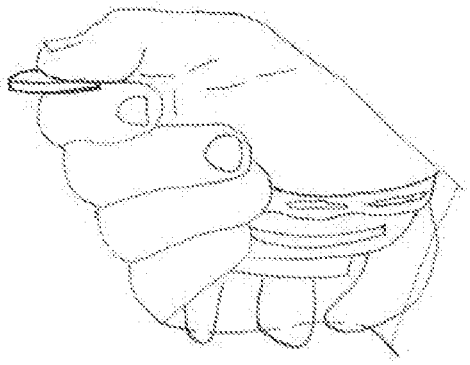
Figure 13:
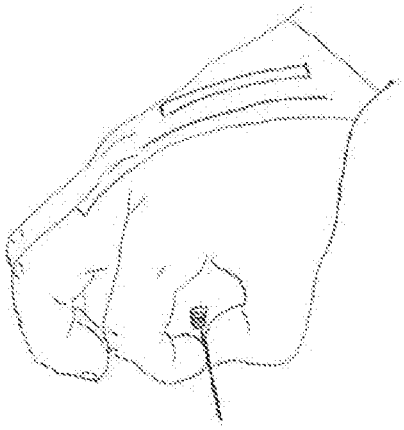
Figure 13A:
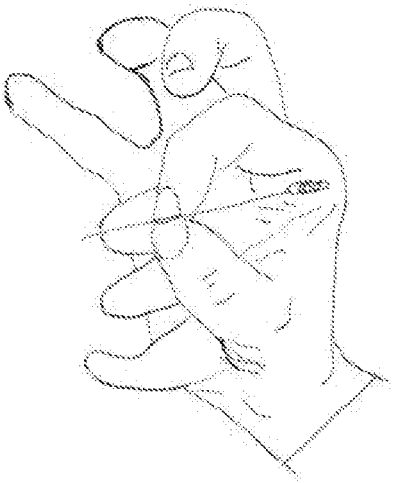

With reference to FIG. 11, the glove is depicted with the opening/closing system in the opening configuration, the glove applied to the right hand and in back side view, the number 3 indicates the hem which embraces the third finger and which rises up to half of the first phalanx of the third finger and embraces half of the circumference of the finger itself; the dashed line indicates the part of the hem hidden by the presence of the finger.

With reference to FIGS. 12, 12A, 13 and 13A, as described above, some illustrative examples of the possibilities of precision and versatility of the glove worn in open mode are illustrated.

As can be seen from the above, the advantages achieved by the quick opening/closing system of a glove for sliding out the first three fingers of the invention are clear.

The quick opening/closing system of a glove for sliding out the first three fingers of the hand of the invention advantageously allows to obtain a protection of the hand when the glove is worn closed and, if necessary, to quickly free the first three fingers of a hand or of both hands to perform those gestures which would otherwise be impossible to perform wearing a mitten or traditional glove; in fact, the first three fingers of the hand are completely free from the glove and can, for example, enter a pocket to grab small objects such as coins or keys or the like.

Further advantageous is the fact that the opening system of the invention allows to fully exploit the tactile sensitivity and precision of the fingers.

Further advantageous is the fact that with the opening/closing system of the invention in opening configuration, the fourth and fifth fingers remain tucked in the glove and keep it constrained to the hand preventing it from falling during its use; for example, with this glove a motorcyclist could simply open the system to completely free the first three fingers, remove his wallet and count banknotes without problems, use the touchscreen keyboard of the distributor or phone and then close the system and return to driving.

Further advantageous is the fact that the glove with the opening/closing system of the invention allows, for example, a soldier to protect his hands in an action of climbing on rough terrain to assume a position and then quickly free the first three fingers to adjust the scope of a weapon or place equipment or use technological devices.

Further advantageous is the fact that the glove with the opening/closing system of the invention allows, for example, a motorcyclist to count money or extract cards from his wallet in the event of refuelling without being forced to completely remove the glove with the related problem of having to rest it in a place safe from falls. Further advantageous is the fact that the glove with the opening/closing system of the invention allows, for example, a diver to remove the first three fingers adjust the camera for underwater photographs or for adjustments which require sensitivity and precision.

A further advantage is the possibility of use also in industrial sites where the use of fatigue tools is alternated with the use of technological devices such as touchscreens or keyboards.

The system of the invention can be used for various types of gloves made of different materials (for example, leather, cordura, hide) and with different uses such as motorcycle gloves, military gloves, sports gloves, carpentry or hobby gloves.

Although the invention has been described above with particular reference to an embodiment given merely by way of non-limiting example, numerous modifications and variations will be apparent to a person skilled in the art in the light of the above description. Therefore, the present invention intends to embrace all the modifications and variations which fall within the scope of the following claims.

The invention claimed is:

1. A quick opening/closing system (10) for a glove (A) including a glove body with five fingers extending from the glove body, the first of the five fingers of the glove comprising a thumb of the glove, the quick opening/closing system, comprising:

a cutting line (2) formed on a back portion of the glove (A), the cutting line extending from a location adjacent to the junction between third and fourth fingers of the glove to a location directly below a base of the thumb of the glove and above a wrist of the glove;

wherein the cutting line defines an openable portion (B) that is integrally formed with the glove body;

wherein the openable portion (B) is configured to pivot or separate along the cutting line to permit repeated opening and closing of the glove; and wherein the openable portion is configured to allow the selective exposure of the first three fingers of a hand of a user while keeping the fourth and fifth fingers of the user covered by the glove.

2. The quick opening/closing system (10) according to claim 1, characterized in that the system comprises quick opening/closing means of the openable portion (B) of the glove (A).

3. The quick opening/closing system (10) according to claim 2, characterized in that the quick opening/closing means comprise a tab (4) externally protruding from an edge of the cutting line (2) of the openable portion (B) of the glove to allow an easy grasp of the opposite hand to open and close the glove.

4. The quick opening/closing system (10) according to claim 3, characterised in that the quick opening/closing means comprise stopping or constrain means of the openable portion (B) with respect to the glove (A).

5. The quick opening/closing system (10) according to claim 4, characterised in that the stopping or constrain means comprise, on a back side of the glove, a hook and loop fastener surface comprising two parts or strips coupled and defined by a first surface or strip (7) on the back side of the glove (A) and a second surface or strip (9) on an inner front of the tab (4) of the openable portion (B) facing the back of the glove.

6. The quick opening/closing system (10) according to claim 5, characterised in that the fourth finger of the glove comprises a first hem (3) which goes up towards a tip of third finger of the glove and reaches up to the middle of a first phalanx of the third finger of the glove, embraces the first phalanx for half of its circumference, from the midline of the back of the finger to the midline of the opposite side, covering the middle of the third finger of the glove facing the fourth finger of the glove, an external surface of the first hem (3) being coated with soft rubber protecting against water leaks from a base of the third finger to the end of the first hem (3) and from the base of the third finger of the glove to the middle of a first phalanx of the fourth finger of the glove.

7. The quick opening/closing system (10) according to claim 6, characterised in that the third finger of the glove comprises a second hem (3') convex downward, rising up to the middle of the first phalanx of the fourth finger of the glove and resting on the first hem when the glove is closed, an inner face of the second hem (3') of the third finger of the glove being coated with soft rubber protecting against water leaks and resting over the first hem when the glove is closed.

8. The quick opening/closing system (10) according to claim 1, further comprising a strip (6) made of soft rubber with a thickness of approximately 1-2 millimetres, projecting on a back surface of the glove from a base of the fourth finger of the glove to the base of the thumb of the glove and a further strip made of rubber with a thickness of 1-2 millimetres developed on an inner face of the cutting line (2).

9. A quick opening/closing system (10) for a glove (A) including a glove body with a glove thumb, a glove index finger, a glove middle finger, a glove ring finger, and a glove little finger, each extending from the glove body, the quick opening/closing system comprising:

a cutting line (2) formed on a back of the glove body, the cutting line extending from a junction between a base of the glove middle finger and a base of the glove ring finger, to a base of the glove thumb, above a glove wrist;

wherein the cutting line defines an openable portion (B) that is integrally formed with the glove body;

wherein the openable portion (B) is configured to pivot or separate along the cutting line to permit repeated opening and closing of the glove; and wherein the openable portion is configured to allow the selective exposure of a user's thumb, index finger, and middle finger while keeping the user's ring finger and little finger covered by the glove.

10. The quick opening/closing system of claim 9, wherein the glove wrist comprises an unbroken wrap forming an opening adapted to surround the user's wrist.

* * * * *